United States Patent [19]

Theurer

[11] Patent Number: 4,476,360

[45] Date of Patent: Oct. 9, 1984

[54] TERMINAL SEAL FOR ELECTRIC SWITCH

[75] Inventor: Walter C. Theurer, Bradenton, Fla.

[73] Assignee: Eaton Corporation, Cleveland, Ohio

[21] Appl. No.: 449,930

[22] Filed: Dec. 15, 1982

[51] Int. Cl.[3] ..... H01H 9/04

[52] U.S. Cl. ..... 200/302.1

[58] Field of Search ..... 200/302, 339; 411/500, 411/501; 429/181; 292/314; D8/386

[56] References Cited

U.S. PATENT DOCUMENTS

| | | | |
|---|---|---|---|
| 105,031 | 7/1870 | Boyd | 411/501 |
| 928,947 | 7/1909 | Dawson | 411/501 |
| 1,401,573 | 12/1921 | Wood | 429/181 |
| 2,954,452 | 9/1960 | Neumann | 200/302 |
| 3,035,134 | 5/1962 | Hults | 200/302 X |
| 3,222,467 | 12/1965 | Meyer | 200/302 |
| 3,322,914 | 5/1967 | Puccini | 200/302 X |
| 3,821,029 | 6/1974 | Smith | 429/181 |
| 4,268,734 | 5/1981 | Sorenson | 200/302 |

FOREIGN PATENT DOCUMENTS

| | | | |
|---|---|---|---|
| 236013 | 2/1960 | Australia | 200/302 |
| 21015 | 3/1915 | Denmark | 200/302 |
| 1240522 | 8/1960 | France | 200/302 |

*Primary Examiner*—John W. Shepperd
*Assistant Examiner*—Renee S. Kidorf
*Attorney, Agent, or Firm*—W. A. Autio; C. H. Grace

[57] ABSTRACT

A terminal seal for an environmentally sealed electric switch is reduced in cost while maintaining an effective seal by eliminating the O-ring and instead angularly reshaping the lower annular surface (20*d*) of the stationary contact head (20*c*) and the lower annular surface (28*d*) of the contact support rivet (28) to coact with the reversed radii (R1, R2) surface of the terminal hole (14, 18) in the molded nylon base (2). Such coaction, when the stationary contact (20) or the contact support rivet (28) is clamped in place and riveted to the external terminal (24, 32), causes cold flow of the radius (R1) along the reshaped angular surface (20*d*, 28*d*) to provide an effective seal without the need of an O-ring or other packing material or cement.

7 Claims, 4 Drawing Figures

Fig. 1
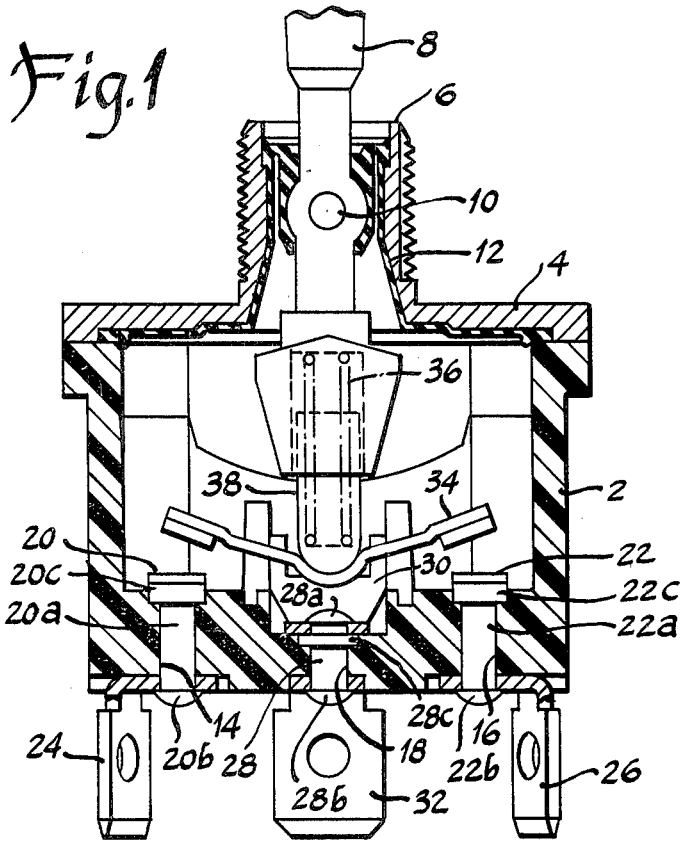
Fig. 2
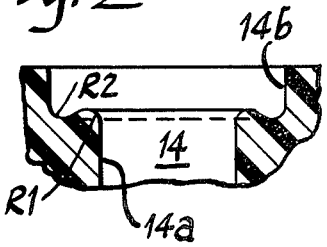
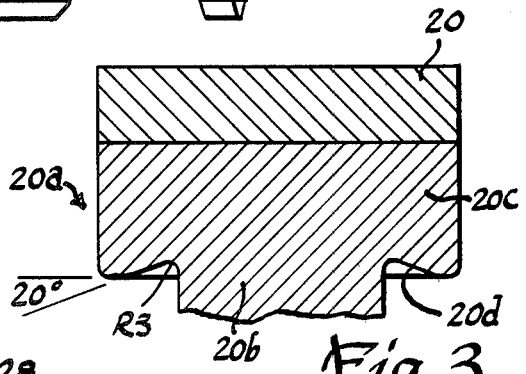
Fig. 3
Fig. 4
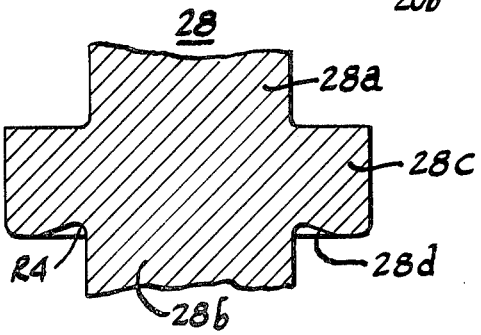

TERMINAL SEAL FOR ELECTRIC SWITCH

BACKGROUND OF THE INVENTION

Switch terminal seals have been known heretofore. For example K. E. Bondurant U.S. Pat. No. 2,658,130, dated Nov. 3, 1953, shows a switch terminal seal consisting of a preformed rubber sleeve which is slipped onto the terminal and the terminal is then pressed into the hole in the switch casing to seal the terminal to the casing. Also L. W. Hamlin U.S. Pat. No. 3,395,260, dated July 30, 1968, shows sealing means for waterproofing electrical switches which comprises use of O-rings to seal not only the dial shaft opening in the switch housing but also to seal screws that extend from the outside of the housing into the interior. And J. W. Elliott et al U.S. Pat. No. 3,612,801, dated Oct. 12, 1971, shows switch terminal sealing means in the form of a sealing grommet of molded silicone rubber material that has switch terminal passages extending therethrough and each such passage having a plurality of annular ring portions spaced apart therealong which grip the terminal to provide a seal. It has also been known to seat a flexible O-ring of rubber or the like on a recessed annular shoulder that surrounds the terminal hole in a molded base and pressing the annular flange of a terminal onto such O-ring to flatten the same and thereby provide a seal between the terminal and the base. All of these prior sealing means have been handicapped by their complexity, difficulty of assembling or rather large cost of manufacture.

SUMMARY OF THE INVENTION

An object of the invention is to provide an improved terminal seal for an electric switch.

A more specific object of the invention is to provide an improved terminal seal for an electric switch that is simple in construction and economical to manufacture but which provides an effective seal.

Other objects and advantages of the invention will hereinafter appear.

BRIEF DESCRIPTION OF THE DRAWINGS

FIG. 1 is an enlarged cross-sectional view of an environmentally sealed, dust-proof and water and moisture resistant, electric switch to which the invention is applied.

FIG. 2 is a still more enlarged fragmentary cross-sectional view of the upper portion of one of the terminal holes in the molded base of the switch of FIG. 1.

FIG. 3 is a similarly enlarged fragmentary cross-sectional view of the upper portion of one of the two stationary terminals of FIG. 1 which will be received in a terminal hole such as that shown in FIG. 2.

FIG. 4 is a similarly enlarged fragmentary view as FIG. 3 of the center terminal rivet of FIG. 1 adapted to be received in a terminal hole in the base such as is shown in FIG. 2.

DESCRIPTION OF THE PREFERRED EMBODIMENT

Referring to FIG. 1, there is shown an electric switch in which the terminal seal of the invention is used. As shown therein, the switch is provided with a rectangular cup-shaped insulating base 2 of thermo-plastic molding material or the like having cold flow characteristics closed at its upper portion by a metal cover 4 having a central upstanding bushing 6 through which a pivotal operating toggle lever 8 extends. Toggle lever 8 is pivotally supported on a pivot pin 10 that extends laterally through the bushing and an enlarged portion on the toggle lever and is riveted or otherwise secured to the bushing. As will be apparent, toggle lever 8 provides access from the outside for operating the switch within the housing which comprises base 2 and cover 4. Cover 4 and bushing 6 and the enlarged portion of the toggle lever are lined with an insulating coating 12 to not only seal the toggle lever opening within the bushing but also to protect the metal cover from possible electrical arcs within the housing.

In a single pole double throw version of switch, the bottom of base 2 is provided with holes 14, 16 and 18 in alignment and in spaced apart relation. The shanks 20*a* and 22*a* or connectors of stationary contacts 20 and 22 extend through holes 14 and 16, respectively, and their reduced lower ends 20*b* and 22*b* are riveted to external terminals 24 and 26, respectively. A flanged connector 28 is riveted at its upper end 28*a* to a movable contact support 30, extends down through hole 18 in the base and is riveted at its lower end 28*b* to an external terminal 32. A movable rocker contact 34 is seated on conductive support 30 and may be actuated by toggle lever 8 into engagement with either stationary contact 20 or 22 thereby to electrically connect either terminal 24 or 26 to common terminal 32. The lower end portion of toggle lever 8 is provided with an upwardly extending blind hole that accommodates an helical compression spring 36 and a plunger 38 which plunger engages movable contact 34 and slides therealong when the toggle lever is actuated.

While all three holes 14, 16 and 18 are similar in shape, hole 14 has been illustrated in FIG. 2 and will be described in greater detail. As shown in FIG. 2, hole 14 includes a generally cylindrical hole 14*a* up from the bottom of the base terminating in a larger diameter hole 14*b* at its upper end. The surface between smaller diameter portion 14*a* and the larger cylindrical upper portion 14*b* of the rivet hole 14 consists of two reverse radii R1 and R2 as shown in FIG. 2. Radius R1 provides an annular bump at the upper end of rivet hole portion 14*a* while radius R2 provides an annular recess around the annular bump which recess then blends into larger diameter rivet hole portion 14*b*. As shown in FIG. 2, the cross-sectional shape of radius R1 is in the form of an arc of a circle while the shape of radius R2 is also in the form of an arc of a circle except that it is reversed with respect to the arc of radius R1.

It has previously been the practice to use a contact hole shape similar to that shown in FIG. 2 in connection with a resiliant O-ring of rubber or the like which was placed in radius R2. The flat flange of a contact was then clamped down to compress such O-ring and seal the contact terminal to the base.

However, it has been found that by reshaping the enlarged head or flange 20*c* of a stationary contact shank 20*a* and the flange 28*c* of a contact support connector 28 in the manner shown in FIGS. 3 and 4, respectively, an effective seal can be obtained without the use of an O-ring. For this purpose, as shown in FIG. 3, the enlarged head of contact 20 is formed with an undercut providing a surface 20*d* at substantially 20° with the horizontal and then forming a small radius R3 where this 20° surface 20*d* joins with the reduced diameter portion of the stationary contact shank 20*a*. The head 20*c* and shank 20*a* of stationary contact 20 is preferably formed from a base material such as copper whereas the upper contacting portion 20 is preferably formed of good electrically conducting material such as silver cadmium oxide.

As shown in FIG. 4, contact support connector 28 is provided with a flange 28*c* and this flange is similarly undercut to provide a 20° surface 28*d* terminating in a like small radius R4 similar to that described in connection with FIG. 3.

When either the stationary contact shank of FIG. 3 or the contact support connector of FIG. 4 is inserted down into its hole in the molded base of the switch and is clamped down and riveted to the associated external terminal 24 or 32, the surface such as 20*d* in FIG. 3 will press down on radius R1 of the base shown in FIG. 2 and will cause cold flow of the material of the molded base along surface 20*d* and along the shank of the stationary contact to form a tight and effective seal between the stationary contact and the base. While a horizontal surface beneath the head of the stationary contact would not provide an effective seal with the base such as shown in FIG. 2, the angular surface 20*d* coacts with the outer slope of the arcuate and annular bump R1 in the base to cause the molded base material to flow in directions to provide an effective seal.

While the apparatus hereinbefore described is effectively adapted to fulfill the objects stated, it is to be understood that the invention is not intended to be confined to the particular preferred embodiment of terminal seal for electric switch disclosed, inasmuch as it is susceptible of various modifications without departing from the scope of the appended claims.

For example, while the improved sealing structure has been illustrated in connection with a stationary contact shank and a movable contact support connector, it will be apparent that a similar sealing structure could be used for sealing metal cover 4 to base 2. For this purpose, the upper portion of the base could be provided with a step extending with gradual curvature in a closed loop within and around the rim of the base with the shoulder at such step having a bump throughout such closed loop that is rounded in cross-section similar to that shown in FIG. 2. In other words, such step or groove within the rim of the base would have rounded corners, that is, gradual curvature, rather than sharp corners of a rectangular base, or the base could be oval or oblong in interior and/or exterior configuration. Also for this purpose, the metal cover would be cast or formed with a contiguous closed-loop drop complementary to such step with a similar angular surface as is shown in FIGS. 3 and 4 to cause cold flow of the thermoplastic bump on the base along such angular surface when the cover is clamped to the base to provide a tight seal. The cover could be clamped at the corners or portions outside the contiguous sealing surfaces to the base by rivets or the like.

I claim:

1. In an electric switch having a housing comprising a hollow molded insulating base closed by a sealed cover to provide a switch compartment, stationary and movable contacts in said compartment, and an actuator for actuating the movable contact into and out of engagement with said stationary contacts, and holes in said base through which said stationary contacts are connected to terminals for connecting said switch to an external circuit, the improvement comprising:

means sealed to said base and extending through said holes for connecting said stationary contacts to the respective terminals, each comprising:

an electrical connector having an enlarged upper end portion which forms a part of or to which said stationary contact is attached and a reduced cross-section shank portion extending through one of said holes to the corresponding external terminal;

each said hole in said base having a correspondingly enlarged upper end portion to closely surround said enlarged upper end portion of said connector and a correspondingly reduced portion extending down therefrom through said base to closely accommodate said shank portion of said connector, and a surface between said enlarged and reduced portions of said hole having a rounded bump at the lip of said reduced portion of said hole;

and the lower surface of said enlarged upper end portion of said connector being provided with an angular undercut surface extending inwardly and upwardly at a predetermined angle with the horizontal plane and overlying said rounded bump for causing cold flow of said rounded bump of said molded insulating base when said connector is clamped tight and secured to said external terminal thereby to form a tight seal around said connector.

2. The electric switch claimed in claim 1, wherein:

said molded insulating base is made of a plastic material such as nylon that is subject to cold flow under an applied force.

3. The electric switch claimed in claim 1, wherein:

said surface between said enlarged portion and said reduced portion of said hole is provided with a reverse radii cross-sectional configuration which provides said rounded bump at the lip of said reduced portion of said hole and a rounded recess at the periphery of said surface.

4. The electric switch claimed in claim 1, wherein:

said predetermined angle is an angle of substantially 20 degrees.

5. The electric switch claimed in claim 1, wherein:

said enlarged upper end portion of said connector comprises a flange with a reduced portion above it for attaching a movable contact support.

6. The electric switch claimed in claim 1, wherein:

said electrical connector and said hole in said base are both cylindrical in configuration.

7. In an electric switch having a housing comprising a hollow, molded thermo-plastic, insulating base closed by a metal cover to provide a switch compartment, metal stationary and movable contacts in said compartment, and an actuator for actuating the movable contact into and out of engagement with said stationary contacts, and holes in said base through which metal connector members extending from said stationary and movable contacts are connected to terminals for connecting said switch to an external circuit, the improvement comprising:

sealing means between said base and each said metal connector member of said electric switch comprising:

a step in said thermoplastic base around each said hole extending with gradual curvature in a closed loop around a predetermined horizontal plane area and the shoulder at said step having a bump throughout said closed loop that is rounded in cross-section before assembly;

and said metal member having a contiguous portion complementary to said step which is provided with a surface throughout a corresponding closed loop that extends radially inwardly and upwardly at a predetermined angle with said horizontal plane to provide an angular surface sufficient to cause cold flow of the thermo-plastic material of said rounded bump along said angular surface when said contiguous portion of said metal member is clamped tight against said step in said base upon assembly thereby to form a tight seal between said base and said metal member.

* * * * *